US010007287B2

(12) United States Patent
Lee

(10) Patent No.: US 10,007,287 B2
(45) Date of Patent: Jun. 26, 2018

(54) VOLTAGE GENERATION CIRCUIT

(71) Applicant: SK hynix Inc., Icheon-si Gyeonggi-do (KR)

(72) Inventor: Hyun Chul Lee, Icheon-si (KR)

(73) Assignee: SK hynix Inc., Icheon-si Gyeonggi-do (KR)

( * ) Notice: Subject to any disclaimer, the term of this patent is extended or adjusted under 35 U.S.C. 154(b) by 7 days.

(21) Appl. No.: 15/015,266

(22) Filed: Feb. 4, 2016

(65) Prior Publication Data

US 2017/0033691 A1 Feb. 2, 2017

(30) Foreign Application Priority Data

Jul. 31, 2015 (KR) ..... 10-2015-0109040

(51) Int. Cl.
*G05F 3/08* (2006.01)
*G05F 3/24* (2006.01)

(52) U.S. Cl.
CPC ..... *G05F 3/08* (2013.01); *G05F 3/245* (2013.01)

(58) Field of Classification Search
CPC . G05F 3/30; G05F 3/245; G05F 3/262; G05F 3/265; G05F 3/225; G05F 3/08
USPC ..... 323/364–367, 369–370, 907
See application file for complete search history.

(56) References Cited

U.S. PATENT DOCUMENTS 6,870,351 B2 * 3/2005 Sugimura ..... G05F 1/573 323/277
7,619,402 B1 * 11/2009 Kwong ..... G05F 1/575 323/297
2003/0212474 A1 * 11/2003 Pippin ..... G06F 1/206 700/300
2008/0054995 A1 * 3/2008 Lin ..... G05F 3/30 327/539
2010/0013454 A1 * 1/2010 Dreps ..... G11O 5/04 323/364
2010/0066434 A1 * 3/2010 Liao ..... G05F 3/245 327/513
2011/0057958 A1 * 3/2011 Morita ..... G09G 3/3233 345/690
2014/0015504 A1 * 1/2014 Sano ..... G05F 3/30 323/282

FOREIGN PATENT DOCUMENTS

KR 1019970059867 A 8/1997
KR 1020090010429 A 1/2009
KR 1020100086598 A 8/2010

* cited by examiner

*Primary Examiner* — Kyle J Moody
*Assistant Examiner* — Kevin H Sprenger
(74) *Attorney, Agent, or Firm* — William Park & Associates Ltd.

(57) ABSTRACT

A voltage generation circuit may include: a current providing block configured to provide, to an output node, a current corresponding to a voltage level of a set voltage, and a voltage level control block configured to adjust the resistance value thereof in response to a voltage control signal, wherein the voltage level control block is coupled between the output node and a ground terminal, and wherein the voltage level control block comprises a first current path unit and a second current path unit having different temperature characteristics.

18 Claims, 2 Drawing Sheets

VOLTAGE GENERATION CIRCUIT

CROSS-REFERENCES TO RELATED APPLICATION

The present application claims priority under 35 U.S.C. § 119(a) to Korean application number 10-2015-0109040 filed on Jul. 31, 2015, in the Korean Intellectual Property Office, which is incorporated herein by reference in its entirety.

BACKGROUND

1. Technical Field

Various embodiments generally relate to a semiconductor integrated circuit, and more particularly to a voltage generation circuit.

2. Related Art

A semiconductor integrated circuit operates on power supply voltages. The semiconductor integrated circuit may generate operating voltages that are used in various operations thereof.

A semiconductor integrated circuit typically includes a large number of transistors. Because transistors are temperature-sensitive devices, temperature variations may highly affect the operations of the semiconductor integrated circuit.

For this reason, there is a need for a voltage generation circuit that is improved in terms of temperature-insensitive characteristics for the semiconductor integrated circuit to stably perform operation thereof over a wide range of temperature.

SUMMARY

In an embodiment, a voltage generation circuit may include: a current providing block configured to provide an amount of current corresponding to a voltage level of a set voltage, to an output node; and a voltage level control block configured to be determined in its resistance level in response to a voltage control signal, and electrically coupled between the output node and a ground terminal, wherein the voltage level control block comprises a first current path unit and a second current path unit which have different temperature characteristics.

In an embodiment, a voltage generation circuit may include: a set voltage generation block configured to generate a set voltage; a current providing block configured to provide current to an output node in response to the set voltage; a first current path unit configured to flow one part of the current provided to the output node, to a ground terminal, in response to a voltage control signal; a second current path unit configured to flow the other part of the current provided to the output node, to the ground terminal, in response to the voltage control signal; and a voltage control signal generation block configured to generate the voltage control signal in response to a setting signal and a mode signal.

In an embodiment, a voltage generation circuit may include: a current providing block configured to provide current to an output node in response to a set voltage; a first current path unit configured to flow one part of the current provided to the output node, to a ground terminal, in response to a voltage control signal; a second current path unit configured to flow the other part of the current provided to the output node, to the ground terminal, in response to the voltage control signal; and a voltage control signal generation block configured to generate the voltage control signal such that a voltage level of the output node is lowered in a power-down mode in comparison with a normal mode, wherein the first current path unit is lowered in its resistance level as a temperature rises, and wherein the second current path unit is raised in its resistance level as a temperature rises.

DETAILED DESCRIPTION

Hereinafter, a voltage generation circuit will be described below with reference to the accompanying drawings through various examples of embodiments.

Figure 1:
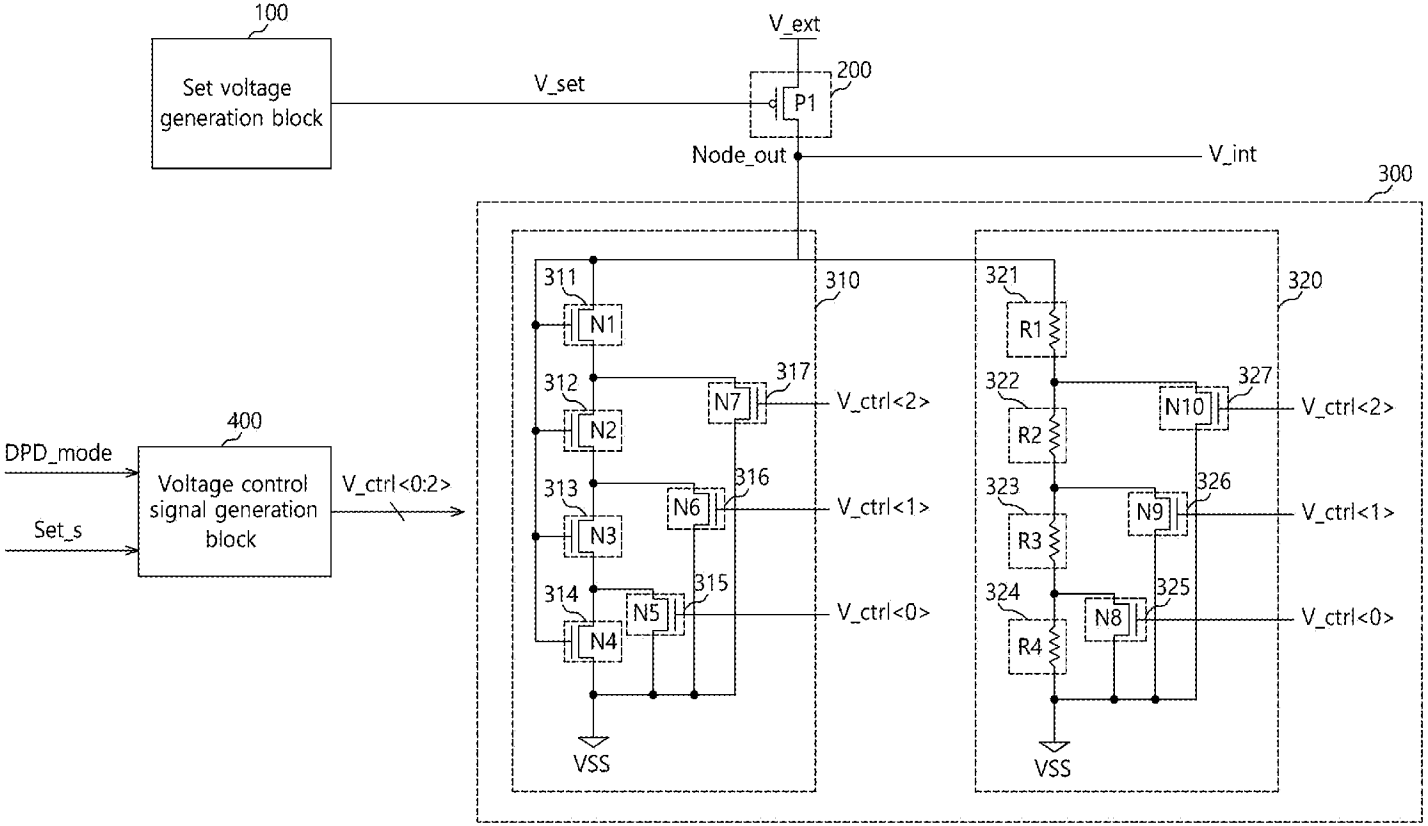
FIG. 1 is a configuration diagram illustrating a voltage generation circuit in accordance with an embodiment.

As shown in FIG. 1, a voltage generation circuit in accordance with an embodiment may include a set voltage generation block 100, a current providing block 200, a voltage level control block 300, and a voltage control signal generation block 400.

The set voltage generation block 100 generates a set voltage V_set of a set voltage level. The set voltage generation block 100 may include a Widlar circuit.

The current providing block 200 provides, to an output node Node_out, current corresponding to the voltage level of the set voltage V_set. For example, an amount of current that is provided to the output node Node_out increases as the voltage level of the set voltage V_set decreases.

The current providing block 200 may include a first transistor P1. The first transistor P1 has a gate that is applied with the set voltage V_set, a source that is applied with an external voltage V_ext, and a drain that is coupled to the output node Node_out.

The voltage level control block 300 coupled between the output node Node_out and a ground terminal VSS may adjust the current flowing through the output node Node_out by changing the total resistance values of the voltage level control block 300 in response to first to third voltage control signals V_ctrl<0:2>. In an embodiment, the voltage level control block 300 may have a configuration that forms, between the output node Node_out and the ground terminal VSS, two or more current paths with different temperature characteristics in response to the first to third voltage control signals V_ctrl<0:2>. For instance, the voltage level control block 300 forms two current paths with different temperature characteristics as shown in FIG. 1. As a result, the voltage level of the output node Node_out may vary depending on the amount of current flowing therethrough that varies depending on the total resistance values of the voltage level control block 300, which is adjusted in response to the first to third voltage control signals V_ctrl<0:2>.

In an embodiment, the voltage level control block 300 may include a first current path unit 310 and a second current path unit 320. The temperature characteristics of the first and second current path units 310 and 320 may be different from one another. The first and second current path units 310 and 320 may be electrically coupled in parallel between the output node Node_out and the ground terminal VSS. Accordingly, the total current flowing between the output node Node_out and the ground terminal VSS may include a current flowing through the first current path unit 310 in response to the first to third voltage control signals V_ctrl<0:2> and a current flowing through the second current path unit 320 in response to the first to third voltage control signals V_ctrl<0:2>.

The resistance value of the first current path unit 310 coupled between the output node Node_out and the ground terminal VSS may be determined depending on temperature variations and the first to third voltage control signals V_ctrl<0:2>. For example, the resistance value of the first current path unit 310, which varies according to the first to third voltage control signals V_ctrl<0:2>, decreases as temperature increases. The first current path unit 310 may include first to fourth active resistor elements 311, 312, 313, and 314 and first to third switches 315, 316, and 317, which are coupled in series between the output node Node_out and the ground terminal VSS. The first to fourth active resistor elements 311, 312, 313, and 314 may have characteristics that the resistance values decrease as temperature increases.

The first active resistor element 311 may include a first transistor N1 having gate and drain that are coupled to the output node Node_out and a source coupled to the second active resistor element 312.

The second active resistor element 312 may include a second transistor N2 having a gate coupled to the output node Node_out, a drain coupled to the source of the first transistor N1, and a source coupled to the third active resistor element 313.

The third active resistor element 313 may include a third transistor N3 having a gate coupled to the output node Node_out, a drain coupled to the source of the second transistor N2, and a source coupled to the fourth active resistor element 314.

The fourth active resistor element 314 may include a fourth transistor N4 having a gate coupled to the output node Node_out, a drain coupled to the source of the third transistor N3, and a source coupled to the ground terminal VSS.

The first switch 315 provides, in response to the first voltage control signal V_ctrl<0>, a bypass path that allows at least a part of the current that would have otherwise flowed through the fourth active resistor element 314 to flow through the first switch 315. For example, the first switch 315 may be switched-off to prevent the current from flowing therethrough when the first voltage control signal V_ctrl<0> is in an inactive state, whereas the first switch 315 may allow at least a part of the current to bypass when the first voltage control signal V_ctrl<0> is in an active state.

The first switch 315 may include a fifth transistor N5 having a gate that is inputted with the first voltage control signal V_ctrl<0>, a drain coupled to the third active resistor element 313 (e.g., the source of the third transistor N3), and a source coupled to the ground terminal VSS.

The second switch 316 provides, in response to the second voltage control signal V_ctrl<1>, a bypass path that allows at least a part of the current that would have otherwise flowed through the third active resistor element 313 to flow through the second switch 316. For example, the second switch 316 may be switched-off to prevent the current from flowing therethrough when the second voltage control signal V_ctrl<1> is in an inactive state, whereas the second switch 316 may allow at least a part of the current to bypass when the second voltage control signal V_ctrl<1> is in an active state.

The second switch 316 may include a sixth transistor N6 having a gate that is inputted with the second voltage control signal V_ctrl<1>, a drain coupled to the second active resistor element 312 (e.g., the source of the second transistor N2), and a source coupled to the ground terminal VSS.

The third switch 317 provides, in response to the third voltage control signal V_ctrl<2>, a bypass path that allows at least a part of the current that would have otherwise flowed through the second active resistor element 312 to flow through the second switch 316. For example, the third switch 317 may be switched-off to prevent the current from flowing therethrough when the third voltage control signal V_ctrl<2> is in an inactive state, whereas the third switch 317 may allow at least a part of the current to bypass when the third voltage control signal V_ctrl<2> is in an active state.

The third switch 317 may include a seventh transistor N7 having a gate that is inputted with the third voltage control signal V_ctrl<2>, a drain coupled to the first active resistor element 311 (e.g., the source of the first transistor N1), and a source coupled to the ground terminal VSS.

The resistance value of the second current path unit 320 coupled between the output node Node_out and the ground terminal VSS may be determined depending on temperature variations and the first to third voltage control signals V_ctrl<0:2>. For example, the resistance value of the second current path unit 320, which varies according to the first to third voltage control signals V_ctrl<0:2>, decrease as temperature increase.

The second current path unit 320 may include first to fourth passive resistor elements 321, 322, 323, and 324 and fourth to sixth switches 325, 326, and 327 which are coupled in series between the output node Node_out and the ground terminal VSS. The first to fourth passive resistor elements 321, 322, 323, and 324 may have characteristics that the resistance values decrease as temperature increases.

The first passive resistor element 321 may include a first resistor R1 having a first end coupled to the output node Node_out and a second end coupled to the second passive resistor element 322.

The second passive resistor element 322 may include a second resistor R2 having a first end coupled to the first passive resistor element 321 and a second end coupled to the third passive resistor element 323.

The third passive resistor element 323 may include a third resistor R3 having a first end coupled to the second passive resistor element 322 and a second end coupled to the fourth passive resistor element 324.

The fourth passive resistor element 324 may include a fourth resistor R4 having a first end coupled to the third passive resistor element 323 and a second end coupled to the ground terminal VSS.

The fourth switch 325 provides, in response to the first voltage control signal V_ctrl<0>, a bypass path that allows at least a part of the current that would have otherwise flowed through the fourth passive resistor element 324 to flow through the fourth switch 325. For example, the fourth switch 325 may be switched-off to prevent the current from flowing therethrough when the first voltage control signal V_ctrl<0> is in an inactive state, whereas the fourth switch 325 may allow at least a part of the current to bypass when the first voltage control signal V_ctrl<0> is in an active state.

The fourth switch 325 may include an eighth transistor N8 having a gate that is inputted with the first voltage control signal V_ctrl<0>, a drain coupled to the third passive resistor element 323 (e.g., the second end of the third resistor R3), and a source coupled to the ground terminal VSS.

The fifth switch 326 provides, in response to the second voltage control signal V_ctrl<1>, a bypass path that allows at least a part of the current that would have otherwise flowed through the third passive resistor element 323 to flow through the fifth switch 316. For example, the fifth switch 326 may be switched-off to prevent the current from flowing therethrough when the second voltage control signal V_ctrl<1> is in an inactive state, whereas the fifth switch 326 may allow at least a part of the current to bypass when the second voltage control signal V_ctrl<1> is in an active state.

The fifth switch 326 may include a ninth transistor N9 having a gate that is inputted with the second voltage control signal V_ctrl<1>, a drain coupled to the second passive resistor element 322 (e.g., the second end of the second resistor R2), and a source coupled to the ground terminal VSS.

The sixth switch 327 provides, in response to the third voltage control signal V_ctrl<2>, a bypass path that allows at least a part of the current that would have otherwise flowed through the second passive resistor element 322 to flow through the sixth switch 327. For example, the sixth switch 327 may be switched-off to prevent the current from flowing therethrough when the third voltage control signal V_ctrl<2> is in an inactive state, whereas the sixth switch 327 may allow at least a part of the current to bypass when the third voltage control signal V_ctrl<2> is in an active state.

The sixth switch 327 may include a tenth transistor N10 having a gate that is inputted with the third voltage control signal V_ctrl<2>, a drain coupled to the first passive resistor element 321 (e.g., the second end of the first resistor R1), and a source coupled to the ground terminal VSS.

The resistance values of the first and second current path units 310 and 320 may vary depending on the first to third voltage control signals V_ctrl<0:2>. Also, each of the first and second current path units 310 and 320 may have the highest resistance value when the first voltage control signal V_ctrl<0> is in an active state, whereas each of the first and second current path units 310 and 320 may have the lowest resistance value when the third voltage control signal V_ctrl<2> is in an active state. Although the first and second current path units 310 and 320, which are provided as an example, include three active resistor elements coupled in series and four passive resistor elements coupled in series, it is to be noted that the number of resistor elements is not specifically limited and the number of switches is not specifically limited as well. Moreover, the first and second current path units 310 and 320 are provided as configuration examples that include pluralities of resistor elements having different temperature characteristics to change the total resistance value of the first and second current path units 310 and 320 in response to a plurality of voltage control signals V_ctrl<0:2>.

The voltage control signal generation block 400 outputs the first to third voltage control signals V_ctrl<0:2> in response to a setting signal Set_s and a mode signal DPD_mode. For example, the voltage control signal generation block 400 stores voltage control information in response to the setting signal Set_s, and outputs the stored voltage control information in response to the mode signal DPD_mode. In an embodiment, the voltage control signal generation block 400 stores voltage control information to enable one of the first to third voltage control signals V_ctrl<0:2> according to the setting signal Set_s, and enables one of the first to third voltage control signals V_ctrl<0:2> according to the stored voltage control information when the mode signal DPD_mode is enabled. The mode signal DPD_mode may be a power-down mode signal, and the power-down mode signal is a signal that is enabled in a case where a semiconductor integrated circuit is in a power-down mode. While the mode signal DPD_mode, which is enabled in a power-down mode, is described as an example in the voltage generation circuit in accordance with an embodiment, it is to be noted that the voltage generation circuit in accordance with an embodiment may apply to a mode for reducing current consumption in comparison with a normal mode, for example, a standby mode, a deep power-down mode, and so forth.

Figure 2:
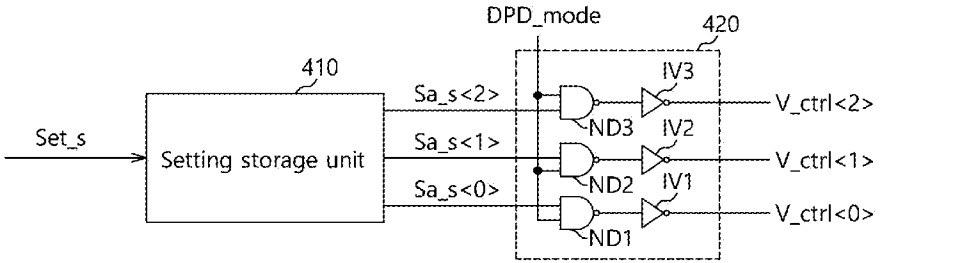
FIG. 2 is a configuration diagram illustrating a voltage control signal generation block in accordance with an embodiment.

As shown in FIG. 2, the voltage control signal generation block 400 may include a setting storage unit 410 and an output control unit 420.

The setting storage unit 410 stores voltage control information in response to the setting signal Set_s, and outputs the stored voltage control information as first to third storage signals Sa_s<0:2>. The setting storage unit 410 may include a flip-flop, a register, a mode register set, or a CAM.

The output control unit 420 outputs the first to third storage signals Sa_s<0:2> as the first to third voltage control signals V_ctrl<0:2> in response to the mode signal DPD_mode. For example, the output control unit 420 outputs the first to third storage signals Sa_s<0:2> as the first to third voltage control signals V_ctrl<0:2> when the mode signal DPD_mode is enabled. The output control unit 420 disables the first to third voltage control signals V_ctrl<0:2> regardless of the first to third storage signals Sa_s<0:2> when the mode signal DPD_mode is disabled.

The output control unit 420 may include first to third NAND gates ND1, ND2, and ND3, and first to third inverters IV1, IV2, and IV3. The first NAND gate ND1 is inputted with the first storage signal Sa_s<0> and the mode signal DPD_mode. The first inverter IV1 is inputted with the output signal of the first NAND gate ND1, and outputs the first voltage control signal V_ctrl<0>. The second NAND gate ND2 is inputted with the second storage signal Sa_s<1> and the mode signal DPD_mode. The second inverter IV2 is inputted with the output signal of the second NAND gate ND1, and outputs the second voltage control signal V_ctrl<1>. The third NAND gate ND3 is inputted with the third storage signal Sa_s<2> and the mode signal DPD_mode. The third inverter IV3 is inputted with the output signal of the third NAND gate ND3, and outputs the third voltage control signal V_ctrl<2>.

The operation of the voltage generation circuit in accordance with an embodiment will be described below.

Referring to FIG. 1, the set voltage V_set is generated from the set voltage generation block 100.

The amount of current that current providing block 200 provides to the output node Node_out may correspond to the voltage level of the set voltage V_set.

The current provided to the output node Node_out flows to the ground terminal VSS through the voltage level control block 300. The voltage level of the voltage formed in the output node Node_out is determined according to the resistance value of the voltage level control block 300. The voltage formed in the output node Node_out is referred to as an internal voltage V_int.

The voltage level control block 300 includes the first current path unit 310 and the second current path unit 320.

The first current path unit 310 includes the first to fourth active resistor elements 311, 312, 313, and 314, which are coupled in series.

The second current path unit 320 includes the first to fourth passive resistor elements 321, 322, 323, and 324, which are coupled in series.

The resistance values of the first to fourth active resistor elements 311, 312, 313, and 314 decrease as temperature increases. The resistance values of the first to fourth passive resistor elements 321, 322, 323, and 324 increase as temperature increases.

Figure 3:
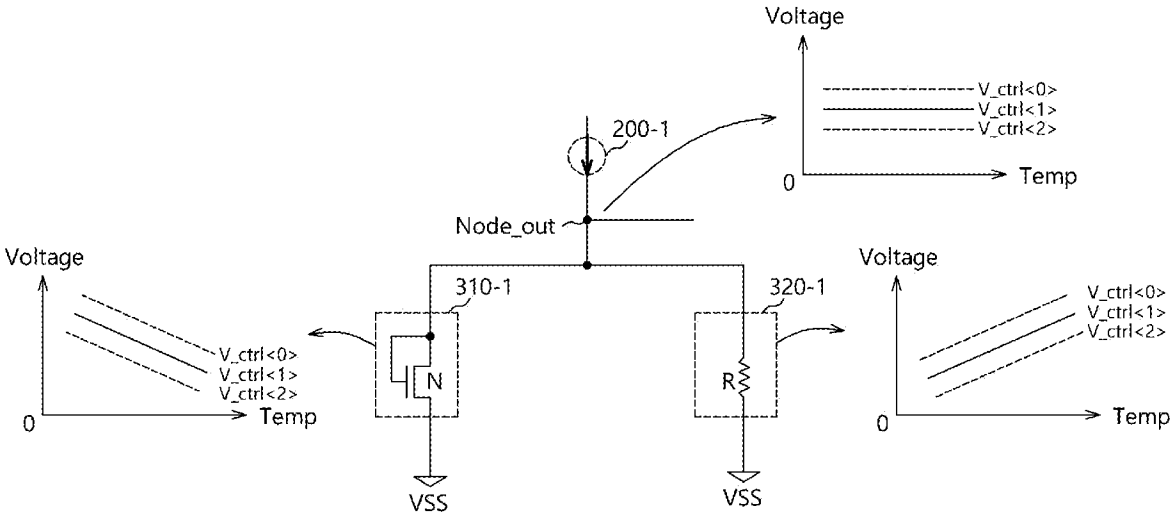
FIG. 3 is a diagram provided to assist in explaining a voltage generation circuit in accordance with an embodiment.

The operations of the first and second current path units 310 and 320 will be described below with reference to FIG. 3. Although the first and second current path units 310 and 320 may include a plurality of active resistor elements and a plurality of passive resistor elements as shown in FIG. 1, FIG. 3 provides a simplified configuration including a first current path unit 310-1 with a single active resistor element and the second current path unit 320-1 with a single passive resistor element to assist in explaining the operations of the first and second current path units 310 and 320.

The first current path unit 310-1 including an active resistor element N decreases the resistance thereof as temperature increases, and the second current path unit 320-1 including a passive resistor element R increases the resistance thereof as temperature increases.

Since the first and second current path units 310-1 and 320-1 are provided with a constant amount of current from a current providing block 200-1, the voltage formed by the first current path unit 310-1 decreases as temperature increases, and the voltage formed by the second current path unit 320-1 increases as temperature increases.

Therefore, when the constant amount of current is provided from the current providing block 200-1, the voltage level of the output node Node_out to which the first and second current path units 310-1 and 320-1 are coupled in common has a constant value regardless of a temperature variation.

As shown in FIG. 1, the voltage generation circuit in accordance with an embodiment may control the voltage level of the output node Node_out, which is the voltage level of the internal voltage V_int, by controlling the resistance values of the first current path unit 310 and the second current path unit 320 in response to the activation of one of the first to third voltage control signals V_ctrl<0:2>. Because the first and second current path units 310 and 320 have the highest resistance values when the first voltage control signal V_ctrl<0> is in an active state, the highest voltages are formed in the first and second current path units 310 and 320 when the first voltage control signal V_ctrl<0> is in an active state. Also, because the first and second current path units 310 and 320 have the lowest resistance values when the third voltage control signal V_ctrl<2> is in an active state, the lowest voltages are formed in the first and second current path units 310 and 320 when the third voltage control signal V_ctrl<2> is in an active state. As a result, in the same manner, the voltage of the output node Node_out (i.e., the internal voltage V_int) has the highest voltage level when the first voltage control signal V_ctrl<0> is in an active state, and has the lowest voltage level when the third voltage control signal V_ctrl<2> is in an active state.

The voltage generation circuit in accordance with an embodiment may generate an internal voltage with a constant voltage level regardless of a temperature variation or may minimize an internal voltage variation that is caused by a temperature variation. In addition, the voltage generation circuit in accordance with an embodiment may raise or lower the voltage level of the internal voltage.

In addition, referring to FIG. 2, if the mode signal DPD_mode is enabled, then one of the first to third voltage control signals V_ctrl<0:2> is enabled and inputted to the first and second current path units 310 and 320. In the voltage generation circuit in accordance with an embodiment, therefore, in a case where the semiconductor integrated circuit exits a normal mode and then enters a power-down mode, the voltage level of the output node Node_out may decrease according to the voltage control information stored in the setting storage unit 410.

While various embodiments have been described above, it will be understood to those skilled in the art that the embodiments described are examples only. Accordingly, the voltage generation circuit described herein should not be limited based on the described embodiments.

What is claimed is:

1. A voltage generation circuit comprising:

a current providing block configured to provide, to an output node, a current corresponding to a voltage level of a set voltage; and a voltage level control block configured to adjust the resistance value thereof in response to a plurality of voltage control signals, wherein the voltage level control block is coupled between the output node and a ground terminal, and wherein the voltage level control block comprises a first current path unit and a second current path unit having different temperature characteristics, wherein the first current path unit is configured to receive the voltage control signals and include first elements, whose resistance value decreases as a temperature increases and a plurality of first switches configured to turn on in response to the voltage control signals, the second current path unit is configured to receive the voltage control signals and include second elements whose resistance value increases as the temperature increases and a plurality of second switches configured to turn on the voltage control signals, and a number of the first elements is equal to a number of the second elements, and wherein a connection configuration of the first elements and the first switches corresponds to a connection configuration of the second elements and the second switches.

2. The voltage generation circuit according to claim 1, wherein the voltage level control block controls a voltage level of the output node by allowing a current corresponding to a resistance value that is adjusted according to the voltage control signals to flow to the ground terminal.

3. The voltage generation circuit according to claim 2, wherein the first current path unit and the second current path unit are coupled in parallel between the output node and the ground terminal.

4. The voltage generation circuit according to claim 3, wherein the resistance value of the first elements is adjusted in response to the voltage control signals.

5. The voltage generation circuit according to claim 4, wherein:

the first current path unit includes a plurality of MOS transistors coupled in series, as the first elements, between the output node and the ground terminal, and the plurality of first switches are configured to electrically connect respective nodes between the plurality of MOS transistors and the ground terminal.

6. The voltage generation circuit according to claim 3, wherein the resistance value of the second elements is adjusted in response to the voltage control signals.

7. The voltage generation circuit according to claim 6, wherein:

the second current path unit includes a plurality of passive resistor elements coupled in series, as the second elements, between the output node and the ground terminal, the plurality of second switches are configured to electrically connect respective nodes between the plurality of passive resistor elements and the ground terminal.

8. A voltage generation circuit comprising:

a set voltage generation block configured to generate a set voltage;

a current providing block configured to provide current to an output node in response to the set voltage;

a first current path unit configured to flow, to a ground terminal, a part of the current provided to the output node in response to a first combination of a voltage control signal;

a second current path unit configured to flow, to the ground terminal, another part of the current provided to the output node in response to a second combination of the voltage control signal; and a voltage control signal generation block configured to generate the voltage control signal in response to a setting signal and a mode signal, wherein the first current path unit receives the voltage control signal, and the second current path unit receives the voltage control signal, wherein the first current path unit includes a plurality of active resistor elements coupled in series between the output node and the ground terminal and a plurality of first switches connected to the plurality of active resistor elements, each active resistor element having a resistance value that decreases as a temperature increases, wherein the second current path unit includes a plurality of passive resistor elements coupled in series between the output node and the ground terminal and a plurality of second switches connected to the plurality of passive resistor elements, each passive resistor element having a resistance value that decreases as the temperature increases, and wherein a number of the active resistor elements is equal to a number of the passive resistor elements, and wherein a connection configuration of the plurality of active resistor elements and the first switches corresponds to a connection configuration of the plurality of passive resistor elements and the second switches.

9. The voltage generation circuit according to claim 8, wherein:

the plurality of first switches are configured to electrically connect respective nodes between the plurality of active resistor elements and the ground terminal; and one of the plurality of switches is turned on in response to the voltage control signal.

10. The voltage generation circuit according to claim 9, wherein:

the plurality of second switches are configured to electrically connect respective nodes between the plurality of passive resistor elements and the ground terminal; and one of the plurality of switches is turned on in response to the voltage control signal.

11. The voltage generation circuit according to claim 9, wherein the voltage control signal generation block comprises:

a setting storage unit configured to store voltage control information in response to the setting signal, and output the stored voltage control information as a storage signal; and an output control unit configured to output the storage signal as the voltage control signal in response to the mode signal.

12. The voltage generation circuit according to claim 11, wherein the setting storage unit comprises a register.

13. The voltage generation circuit according to claim 11, wherein the output control unit outputs the storage signal as the voltage control signal when the mode signal is enabled.

14. A voltage generation circuit comprising:

a current providing block configured to provide current to an output node in response to a set voltage;

a first current path unit configured to allow a part of the current provided to the output node to flow to a ground terminal in response to a voltage control signal;

a second current path unit configured to allow another part of the current provided to the output node to flow to the ground terminal in response to the voltage control signal; and a voltage control signal generation block configured to generate the voltage control signal such that a voltage level of the output node decreases in a power-down mode in comparison with a normal mode, wherein the first current path unit includes a plurality of active resistor elements, whose resistance value decreases as a temperature increases and a plurality of first switches connected to the plurality of active resistor elements, wherein the second current path unit includes a plurality of passive resistor elements, whose resistance value increases as the temperature increases and a plurality of second switches connected to the plurality of passive resistor elements, wherein a number of the active resistor elements is equal to a number of the passive resistor elements, wherein a connection configuration of the plurality of active resistor elements and the first switches corresponds to a connection configuration of the plurality of passive resistor elements and the second switches, wherein the first current path unit receives the voltage control signal, and the second current path unit receives the voltage control signal, and wherein the second switches is directly controlled by the voltage control signals.

15. The voltage generation circuit according to claim 14, wherein:

the plurality of active resistor elements are coupled in series between the output node and the ground terminal;

the plurality of first switches are configured to electrically connect respective nodes between the plurality of active resistor elements and the ground terminal; and one of the plurality of switches is turned on in response to the voltage control signal.

16. The voltage generation circuit according to claim 14, wherein:

the plurality of passive resistor elements are coupled in series between the output node and the ground terminal;

the plurality of second switches are configured to electrically connect respective nodes between the plurality of passive resistor elements and the ground terminal; and one of the plurality of switches is turned on in response to the voltage control signal.

17. The voltage generation circuit according to claim 14, wherein the voltage control signal generation block comprises:

a setting storage unit configured to store voltage control information in response to a setting signal, and output the stored voltage control information as a storage signal; and an output control unit configured to output the storage signal as the voltage control signal in response to a mode signal.

18. The voltage generation circuit according to claim 17, wherein the output control unit disables the voltage control signal regardless of the storage signal when the mode signal is disabled, and enables the voltage control signal according to the storage signal when the mode signal is enabled.

* * * * *